US007069939B1

(12) United States Patent
Conde

(10) Patent No.: US 7,069,939 B1
(45) Date of Patent: Jul. 4, 2006

(54) AUTOMATED UMBRELLA ASSEMBLY

(76) Inventor: Juan C. Conde, 1442 E. Market St., Long Beach, CA (US) 90805

( * ) Notice: Subject to any disclaimer, the term of this patent is extended or adjusted under 35 U.S.C. 154(b) by 117 days.

(21) Appl. No.: 10/944,553

(22) Filed: Sep. 20, 2004

(51) Int. Cl.
*A45B 3/00* (2006.01)

(52) U.S. Cl. ..... 135/16; 135/34.2; 135/25.41; 135/20.3; 224/915

(58) Field of Classification Search ..... 135/16, 135/18, 19, 25.1, 20.3, 34.2, 25.41; 224/915; 206/315.3
See application file for complete search history.

(56) References Cited

U.S. PATENT DOCUMENTS

| | | | | |
|---|---|---|---|---|
| 3,856,030 | A | 12/1974 | Saro | |
| 4,188,965 | A | 2/1980 | Morman | |
| 4,456,023 | A * | 6/1984 | Fujihashi | 135/25.41 |
| 4,572,226 | A | 2/1986 | Williams et al. | |
| 4,962,779 | A * | 10/1990 | Meng | 135/16 |
| 5,213,122 | A | 5/1993 | Grady, II | |
| 5,388,603 | A * | 2/1995 | Bauer et al. | 135/16 |
| 5,449,012 | A * | 9/1995 | Friedman | 135/16 |
| 5,620,034 | A * | 4/1997 | Flis | 150/159 |
| D391,755 | S | 3/1998 | Grimm et al. | |
| 5,806,742 | A * | 9/1998 | Mott et al. | 224/645 |
| 5,887,771 | A | 3/1999 | Perry | |
| 6,015,077 | A | 1/2000 | Disher | |
| 6,910,491 | B1 * | 6/2005 | Wu | 135/34.2 |

* cited by examiner

*Primary Examiner*—Winnie Yip

(57) ABSTRACT

An automated umbrella assembly includes an outer housing having a bottom wall, a top wall and a peripheral wall. A tube is rotatably mounted in the housing. The tube extends upwardly toward an aperture in the top wall and has an open upper end. An inwardly extending threaded lip is attached to an inner surface of the tube. An umbrella includes a shaft having a top end and a bottom end. A plurality of gores is attached to the top end. The gores are selectively positioned in a collapsed position or in an extended position. The shaft has a threaded outer surface and is threadably coupled to the lip. The shaft is extended outwardly through the aperture when the tube is rotated in a first direction and pulled into the outer housing when the tube is rotated in the second direction. A motor is mechanically coupled to the tube.

5 Claims, 5 Drawing Sheets

AUTOMATED UMBRELLA ASSEMBLY

BACKGROUND OF THE INVENTION

1. Field of the Invention

The present invention relates to umbrella devices and more particularly pertains to a new umbrella device for holding an automatically deploying an umbrella.

2. Description of the Prior Art

The use of umbrella devices is known in the prior art. U.S. Pat. No. 6,015,077 describes a covering for an umbrella which allows the umbrella to be attached to a piece of clothing. Another type of umbrella device is U.S. Pat. No. 5,887,771 which describes a garment which is positionable on a person's back and which is adapted for holding an umbrella as well as other devices such as a fan. Yet another similar device is found in U.S. Pat. No. 4,188,965 which includes a belt having a means thereon for selectively mounting an umbrella to the belt wearer's back. The particularly designed umbrella of this device can be selectively collapsed along its length to place it against the back or in a position extending upwardly from the wearer of the belt.

While these devices fulfill their respective, particular objectives and requirements, the need remains for an umbrella which can automatically deployed for use as needed and which remains stored within a housing when not in use. Additionally, the device should include straps so that the housing may be selectively worn on a the back of the umbrella user so that the user may selectively deploy the umbrella so that it unfurls over the head of the user.

SUMMARY OF THE INVENTION

The present invention meets the needs presented above by generally comprising an outer housing having a bottom wall, a top wall and a peripheral wall extending between and being attached to the top and bottom walls. The top wall has an aperture extending therethrough. A tube is rotatably mounted in the housing. The tube extends upwardly toward the aperture and has an open upper end. An inwardly extending threaded lip is attached to an inner surface of the tube and is positioned adjacent to the upper end. An umbrella includes a shaft having a top end and a bottom end. A plurality of gores is attached to the top end. The gores are selectively positioned in a collapsed position against the shaft or in an extended position extended outwardly from the shaft. The gores are biased outwardly. The shaft has a threaded outer surface. The shaft is positioned in the tube and is threadably coupled to the lip. The shaft is extended outwardly through the aperture and the outer housing when the tube is rotated in a first direction and pulled into the outer housing when the tube is rotated in the second direction. A motor is mechanically coupled to the tube for selectively rotating the tube in a first direction or a second direction.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
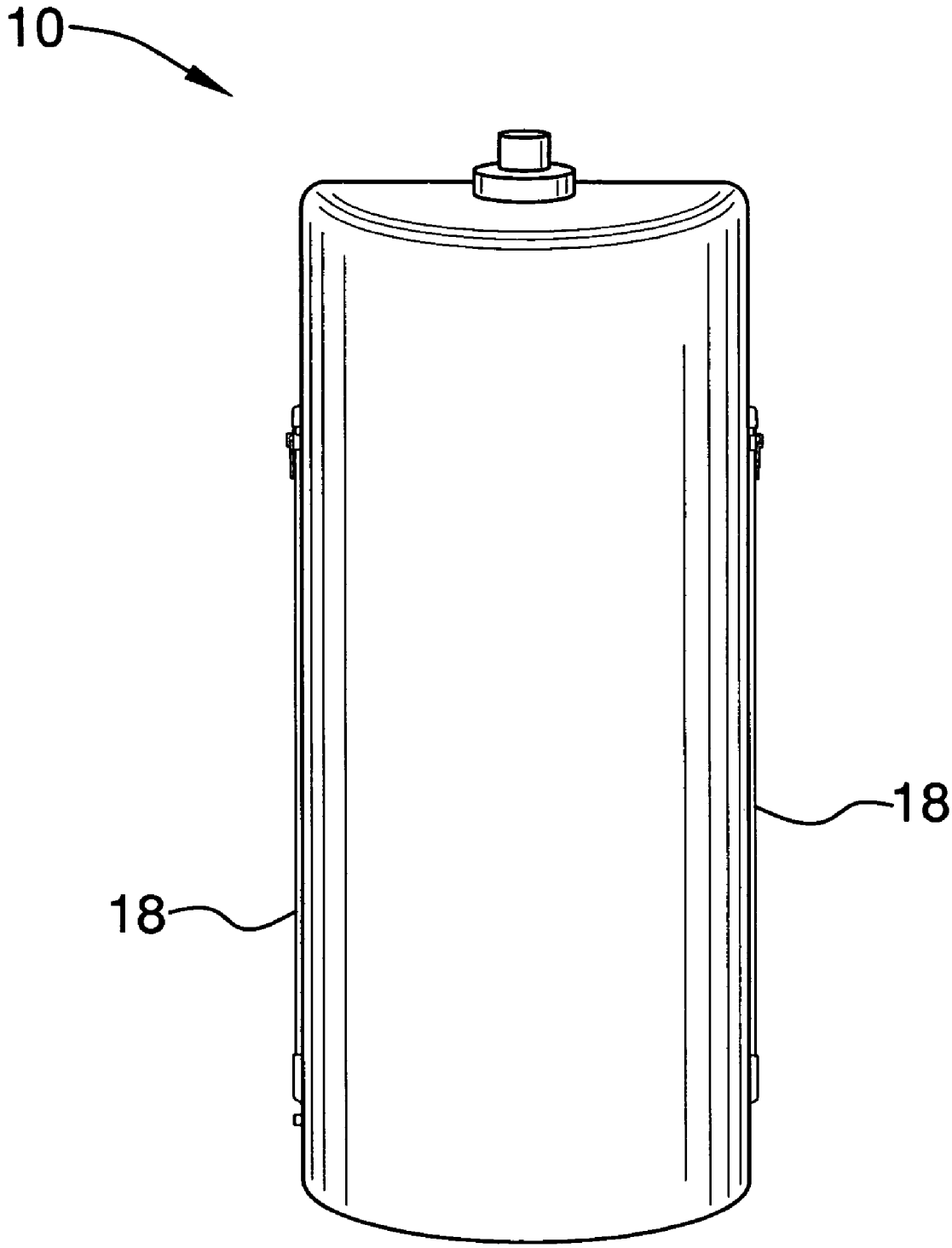
FIG. 1 is a front view of an automated umbrella assembly according to the present invention.
Figure 2:
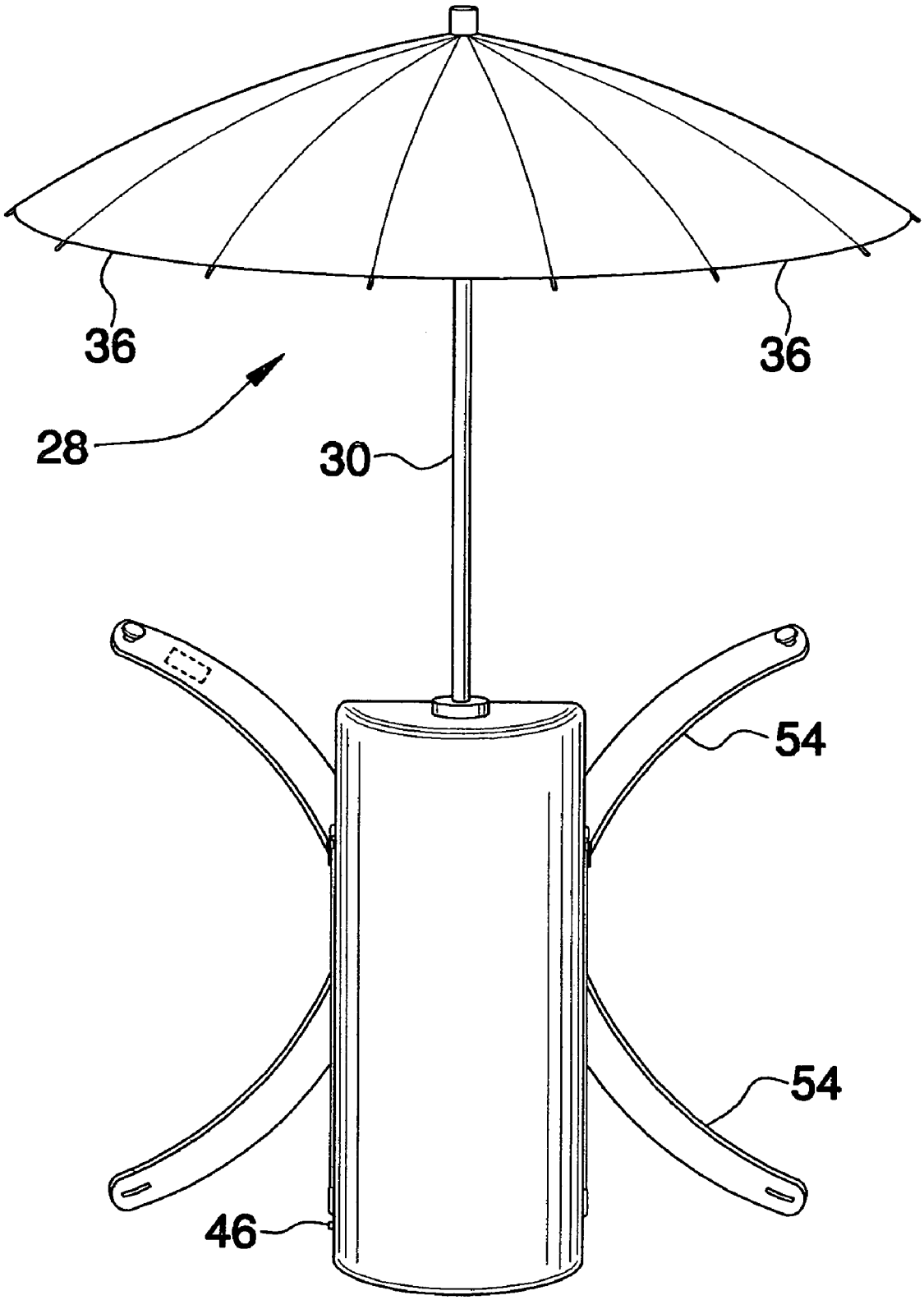
FIG. 2 is a front deployed view of the present invention.
Figure 3:
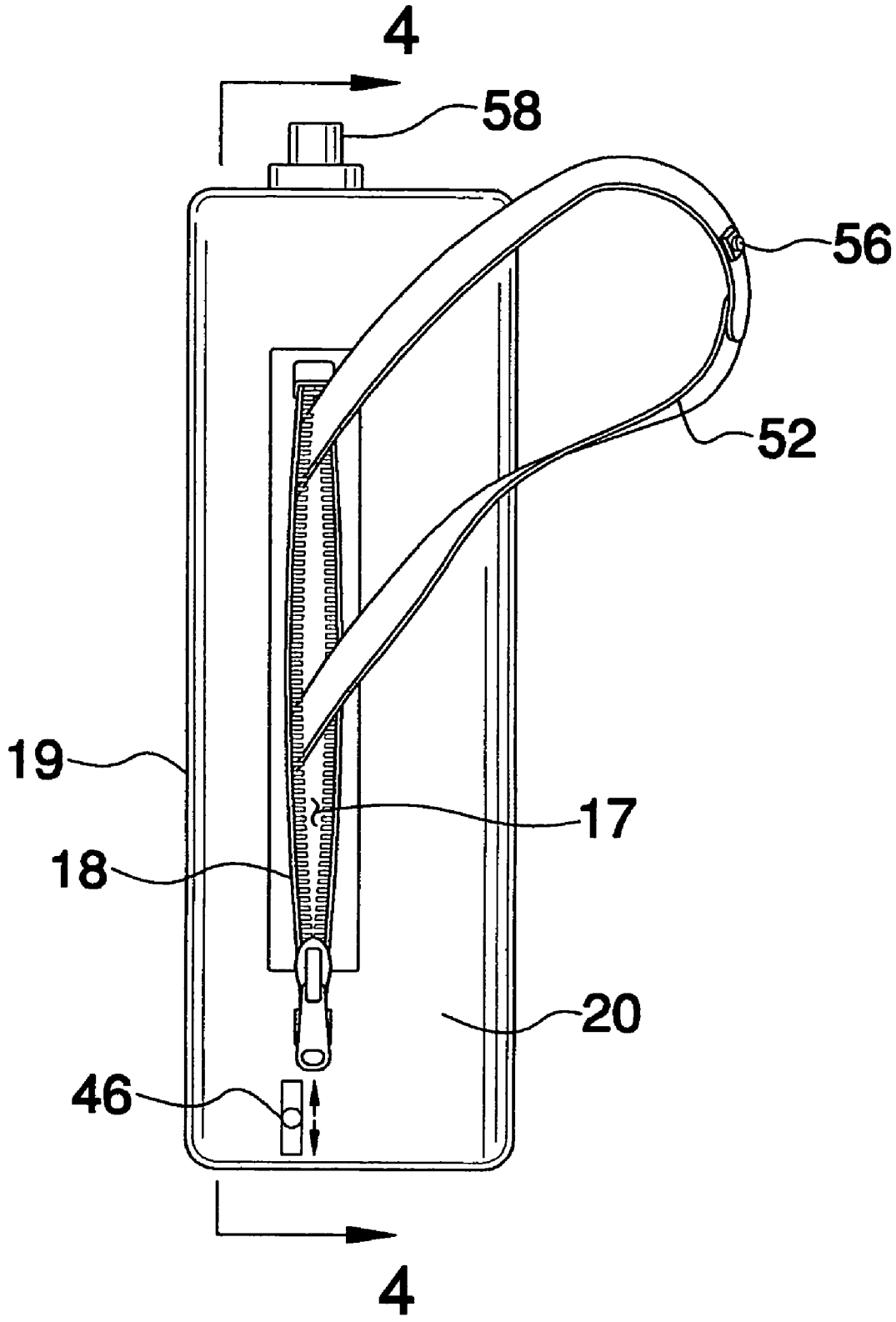
FIG. 3 is a side view of the present invention.
Figure 4:
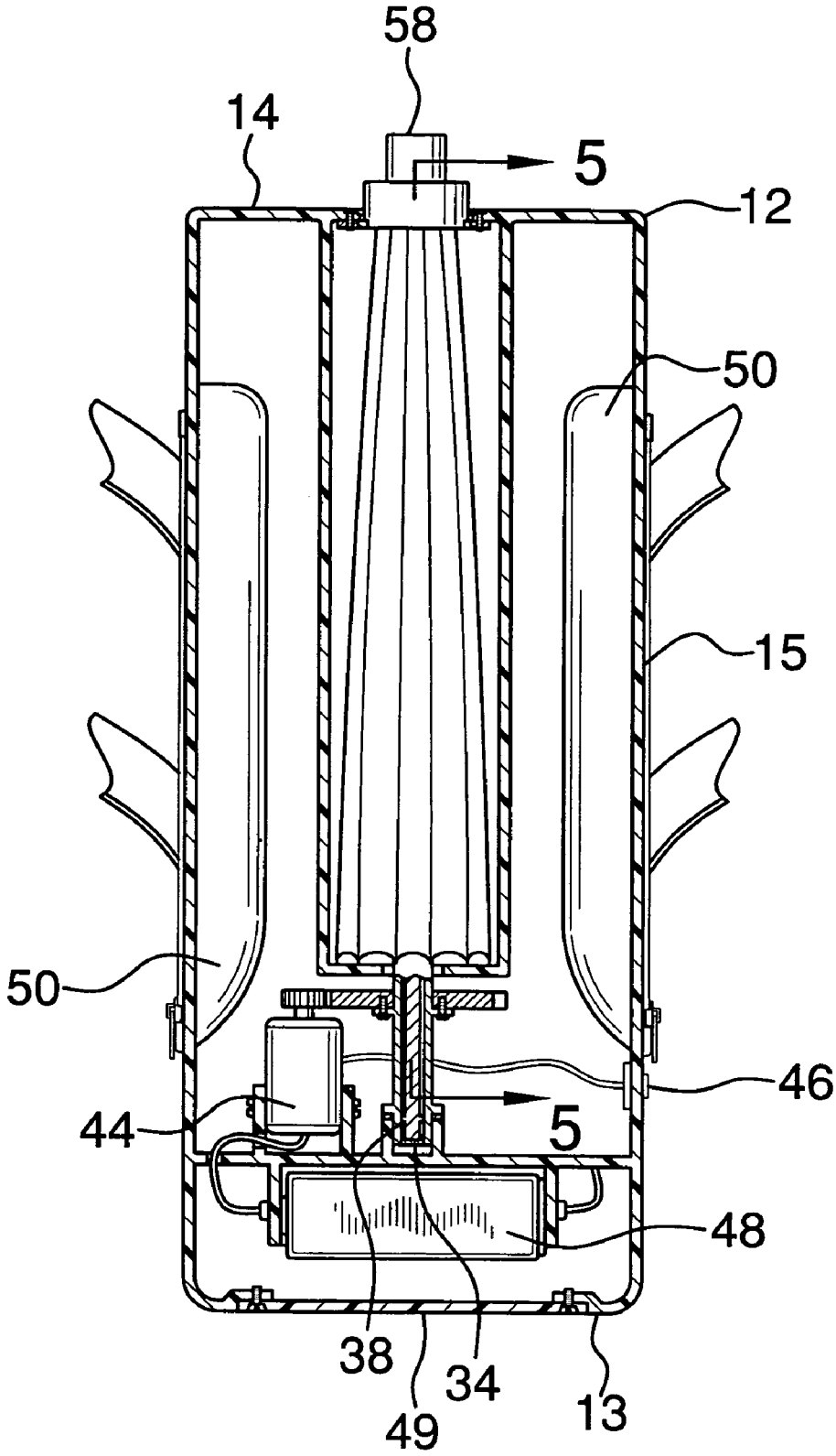
FIG. 4 is a cross-sectional view taken along line 4—4 of FIG. 3 of the present invention.
Figure 5:
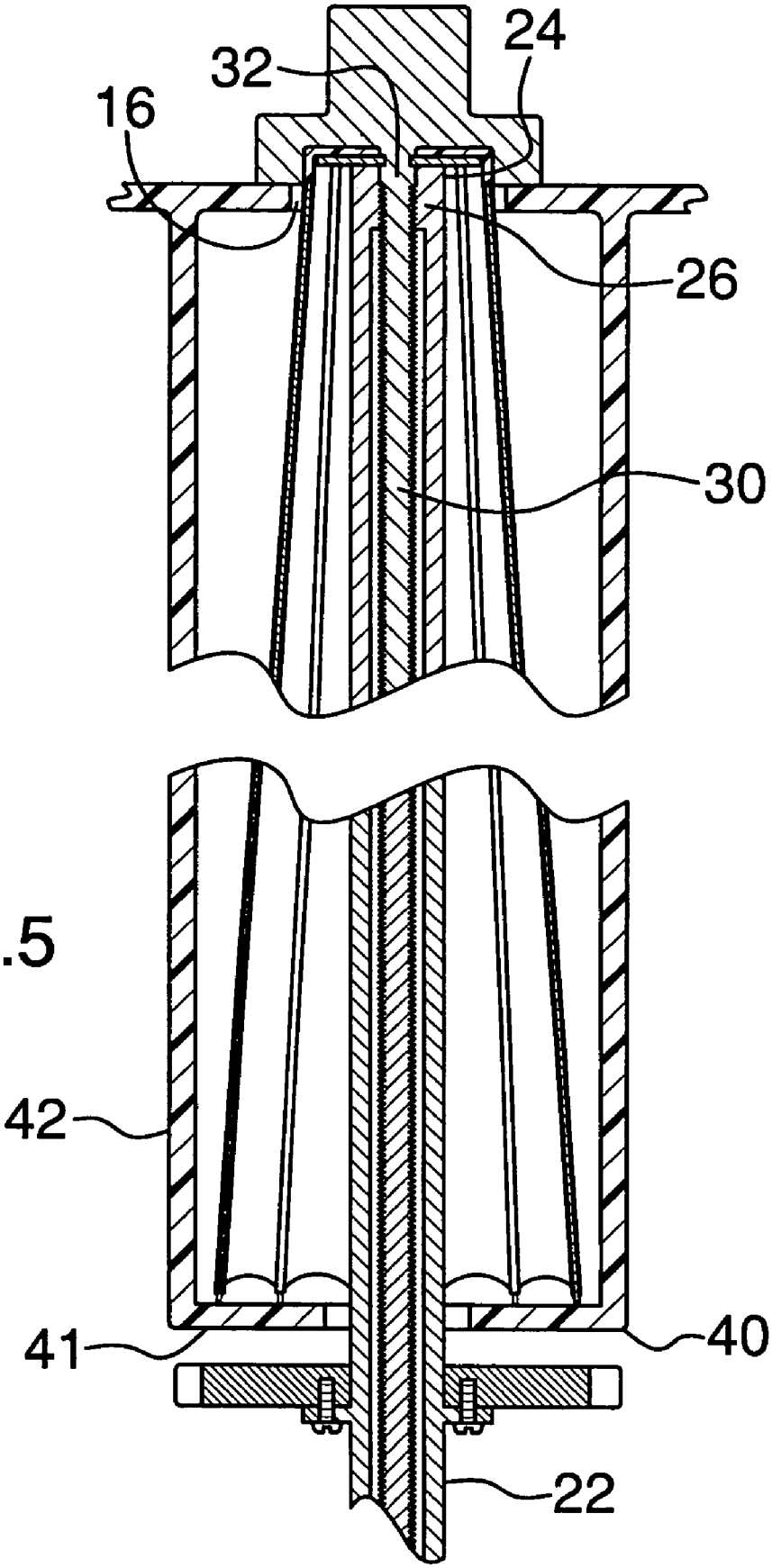
FIG. 5 is a cross-sectional view taken along line 5—5 of FIG. 4 of the present invention.

With reference now to the drawings, and in particular to FIGS. 1 through 5 thereof, a new umbrella device embodying the principles and concepts of the present invention and generally designated by the reference numeral 10 will be described.

As best illustrated in FIGS. 1 through 5, the automated umbrella assembly 10 generally comprises an outer housing 12 that has a bottom wall 13, a top wall 14 and a peripheral wall 15 extending between and is attached to the top 14 and bottom 15 walls. The top wall 14 has an aperture 16 extending therethrough. The outer housing 12 comprises resiliently flexible material such as a plastic or elastomer. The peripheral wall 13 has a pair of elongated slots 17 therein. The slots 17 are positioned generally opposite of each other. Each of pair of closing assemblies 18 is attached to the peripheral wall. The closing assemblies 18 are each positioned adjacent to one of the slots 17 and are adapted for selectively opening or closing an associated one of the slots 17. The closing assemblies 18 are each preferably zippers. The outer housing 12 preferably has a substantially flat side 19 and a semi-circular side 20. The slots 17 are each located on the semi-circular side 20 adjacent to the flat side 19.

A tube 22 is rotatably mounted in the outer housing 12. The tube 22 extends upwardly toward the aperture. The tube 22 has an open upper end 24. An inwardly extending lip 26 is attached to an inner surface of the tube and is positioned adjacent to the upper end. The lip 26 is threaded.

An umbrella 28 includes a shaft 30 that has a top end 32 and a bottom end 34. A plurality of gores 36 is attached to the top end 32 and each is selectively positioned in a collapsed position against the shaft 30 or in an extended position extended outwardly from the shaft 30. The gores 36 are biased outwardly from the shaft 30. The shaft 30 has a threaded outer surface. The shaft 30 is positioned in the tube 22 and is threadably coupled to the lip 26. The shaft 30 is extended outwardly through the aperture 16 and the outer housing 12 when the tube 22 is rotated in a first direction and pulled into the outer housing 12 when the tube 22 is rotated in the second direction. The gores 36 prevent the umbrella 28 from rotating with the tube 22 as it is being extended into and out of the outer housing 12. The shaft 30 has flange 38 thereon positioned adjacent to the bottom end 34. The flange 38 prevents the shaft from escaping the tube 22.

An inner housing 40 has a lower wall 41 and perimeter wall 42 extending upwardly from lower wall 41. The perimeter wall 42 has an upper edge attached to a bottom side of the top wall 14 and extends around the aperture 16. The tube 22 extends through the lower wall 41. The inner housing 40 has a size adapted for receiving the gores 36 when the gores 36 are in the collapsed position. The inner housing 40 ensures that the umbrella 28 moves smoothly into and out of the outer housing 12 and does not become caught on pockets 50 or a motor 44 positioned within the outer housing 12.

The motor 44 is mechanically coupled to the tube 22 for selectively rotating the tube 22 in a first direction or a second direction. A control 46 is operationally coupled to the motor 44 for selectively turning the motor 44 on or off and for selectively rotating the tube 22 in the first direction or the second direction. The motor 44 is positioned between the inner 40 and outer 12 housings. A power supply 48 is electrically coupled to the motor 44. The power supply 48 is preferably a battery removably positioned in the outer housing 12 through a removable door 49 in the bottom wall 13.

Each of a pair of pockets 50 is mounted within the outer housing. Each of the slots 17 extends into one of the pockets 50. Each of a pair of straps 52 is attached to the outer housing 12. The straps 52 are removably positioned in one of the pockets 50. The straps 52 each have a break therein so that each strap 52 includes a pair of tethers 54 selectively attachable together with fasteners 56, such as snaps or buttons. The straps 52 may be used for carrying the automated umbrella assembly 10 as a backpack and for mounting the umbrella 28 on a user's back so that the gores 36 are positioned over the head of a user of the assembly 10.

In use, the motor 44 is turned on and used for rotating the tube 22 in the first direction to extend the umbrella 28 out of the outer housing 12 so that it may be used as a conventional umbrella. When the umbrella 28 is no longer needed, the gores 36 are collapsed by hand against the shaft 30 and the motor 44 used to rotate the tube 22 in the second direction. A cap 58 may be attached to an uppermost end of the umbrella 28 so that the aperture 16 is covered when the umbrella 28 is positioned within the outer housing 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An umbrella apparatus comprising:

an outer housing having a bottom wall, a top wall and a peripheral wall extending between and being attached to said top and bottom walls, said top wall having an aperture extending therethrough;

a tube being rotatably mounted in said outer housing, said tube extending upwardly toward said aperture, said tube having an open upper end, an inwardly extending lip being attached to an inner surface of said tube and being positioned adjacent to said upper end, said lip being threaded;

an umbrella including a shaft having a top end and a bottom end, a plurality of gores being attached to said top end and being selectively positioned in a collapsed position against said shaft or in an extended position extended outwardly from said shaft, said gores being biased outwardly, said shaft having a threaded outer surface, said shaft being positioned in said tube and being threadably coupled to said lip, wherein said shaft is extended outwardly through said aperture and said outer housing when said tube is rotated in a first direction and pulled into said outer housing when said tube is rotated in said second direction; and a motor being mechanically coupled to said tube for selectively rotating said tube in a first direction or a second direction.

2. The umbrella apparatus according to claim 1, said peripheral wall having a pair of elongated slots therein, said slots being positioned generally opposite of each other, each of pair of closing assemblies being attached to said peripheral wall, each of said closing assemblies being positioned adjacent to one of said slots, each of said closing assemblies being adapted for selectively opening or closing an associated one of said slots, a pair of pockets being mounted within said outer housing, each of said slots extending into one of said pockets, each of a pair of straps being attached to said outer housing, each of said straps being removably positioned in one of said pockets.

3. The umbrella apparatus according to claim 1, an inner housing having a lower wall and perimeter wall extending upwardly from lower wall, said perimeter wall having an upper edge attached to a bottom side of said top wall and extending around said aperture, said tube extending through said lower wall, said inner housing having a size adapted for receiving said gores when said gores are in said collapsed position.

4. The umbrella apparatus according to claim 1, further including a control being operationally coupled to said motor for selectively turning said motor on or off and selectively rotating said tube in said first direction or said second direction.

5. An umbrella apparatus comprising:

an outer housing having a bottom wall, a top wall and a peripheral wall extending between and being attached to said top and bottom walls, said top wall having an aperture extending therethrough, said outer housing comprising resiliently flexible material, said peripheral wall having a pair of elongated slots therein, said slots being positioned generally opposite of each other, each of pair of closing assemblies being attached to said peripheral wall, each of said closing assemblies being positioned adjacent to one of said slots, each of said closing assemblies being adapted for selectively opening or closing an associated one of said slots;

a tube being rotatably mounted in said outer housing, said tube extending upwardly toward said aperture, said tube having an open upper end, an inwardly extending lip being attached to an inner surface of said tube and being positioned adjacent to said upper end, said lip being threaded;

an umbrella including a shaft having a top end and a bottom end, a plurality of gores being attached to said top end and being selectively positioned in a collapsed position against said shaft or in an extended position extended outwardly from said shaft, said gores being biased outwardly, said shaft having a threaded outer surface, said shaft being positioned in said tube and being threadably coupled to said lip, wherein said shaft is extended outwardly through said aperture and said outer housing when said tube is rotated in a first direction and pulled into said outer housing when said tube is rotated in said second direction;

an inner housing having a lower wall and perimeter wall extending upwardly from lower wall, said perimeter wall having an upper edge attached to a bottom side of said top wall and extending around said aperture, said tube extending through said lower wall, said inner housing having a size adapted for receiving said gores when said gores are in said collapsed position;

a motor being mechanically coupled to said tube for selectively rotating said tube in a first direction or a second direction, a control being operationally coupled to said motor for selectively turning said motor on or off and selectively rotating said tube in said first direction or said second direction; and a pair of pockets being mounted within said outer housing, each of said slots extending into one of said pockets, each of a pair of straps being attached to said outer housing, each of said straps being removably positioned in one of said pockets.

* * * * *